US007287411B2

(12) United States Patent
Kühne

(10) Patent No.: US 7,287,411 B2
(45) Date of Patent: Oct. 30, 2007

(54) DIE FOR A TOOL SET FOR MECHANICAL JOINING

(75) Inventor: Timm Kühne, Bad Sachsa (DE)

(73) Assignee: Eckold GmbH & Co. KG, Andreasberg (DE)

( * ) Notice: Subject to any disclaimer, the term of this patent is extended or adjusted under 35 U.S.C. 154(b) by 128 days.

(21) Appl. No.: 10/826,661

(22) Filed: Apr. 16, 2004

(65) Prior Publication Data

US 2004/0261486 A1 Dec. 30, 2004

(30) Foreign Application Priority Data

Apr. 17, 2003 (DE) ..... 103 18 060

(51) Int. Cl.

| | |
|---|---|
| ***B21B 25/00*** | (2006.01) |
| ***B21D 26/00*** | (2006.01) |
| ***B21D 41/00*** | (2006.01) |
| ***B23P 11/00*** | (2006.01) |

(52) U.S. Cl. ..... 72/465.1; 72/395; 72/466.9; 29/432.1

(58) Field of Classification Search ..... 29/243.5, 29/521, 524.1, 432.1, 283.5; 72/395, 466.4, 72/465.1, 478, 353.6

See application file for complete search history.

(56) References Cited

U.S. PATENT DOCUMENTS

| | | | | |
|---|---|---|---|---|
| 2,864,157 | A * | 12/1958 | Camprubi | 29/597 |
| 4,208,776 | A * | 6/1980 | Schleicher | 29/243.5 |
| 4,910,853 | A * | 3/1990 | Sawdon | 29/283.5 |
| 5,031,442 | A * | 7/1991 | Kynl | 72/466.8 |
| 5,051,020 | A * | 9/1991 | Schleicher | 403/282 |
| 5,131,258 | A * | 7/1992 | Kynl | 72/466.8 |
| 5,207,086 | A * | 5/1993 | Kynl | 72/466.8 |
| 5,339,509 | A | 8/1994 | Sawdon et al. | |
| 5,509,290 | A * | 4/1996 | Faivre | 72/395 |
| 5,946,782 | A * | 9/1999 | Dubugnon et al. | 29/21.1 |
| 7,003,861 | B2 * | 2/2006 | Sawdon et al. | 29/432 |

FOREIGN PATENT DOCUMENTS

| | | |
|---|---|---|
| EP | 0993902 A2 | 4/2000 |
| WO | WO 94/25196 A1 | 11/1994 |
| WO | WO 97/02912 A1 | 1/1997 |
| WO | WO 01/36124 A2 | 5/2001 |

* cited by examiner

*Primary Examiner*—Derris H. Banks
*Assistant Examiner*—Teresa M. Bonk
(74) *Attorney, Agent, or Firm*—Townsend and Townsend and Crew LLP

(57) ABSTRACT

A die for a tool set includes at least one punch and a die which defines a cavity for effecting joining. The die comprises an anvil opposite the punch. Die segments adjoin the said anvil and define the cavity in the circumferential direction. When the punch is being fed in the direction of the anvil, the segments execute a yielding movement transversely to the punch feed direction.

27 Claims, 5 Drawing Sheets

DIE FOR A TOOL SET FOR MECHANICAL JOINING

BACKGROUND OF THE INVENTION

The invention relates to a die for a tool set for mechanical joining.

EP 0 779 843 B1 discloses a tool set for producing joints on plate-shaped parts, this tool set having a first top tool part with a punch and a second bottom tool part with a round die. The die has an anvil with an anvil body, on which an annular element with a head-side sliding surface and a base-side connection surface are provided. Individual die segments which surround the anvil and are in the shape of ring sections have recesses for concentric flanging of the said die segments to the annular element, this flanging allowing a longitudinally directed movement of the die segments, each die segment being supported in a displaceable manner on the head-side sliding surface under spring preloading, for which purpose an elastic device brings the die segments to bear against the side surface of the anvil.

A disadvantage in this case is that the die segments, on account of their unfavourable ratio of overall height to radial extent, are more likely to tilt than to slide radially and in the process can become skewed and jammed as a result. The support of the die segments on the anvil body decreases during the longitudinally directed outwards movement, since the die segments at least partly run out of the guide. In addition, the die base body must be undercut in the anvil region in order to secure the die segments against axial displacement. This results in an increased risk of fracture of the die base body. The service life of such a die is therefore short. Furthermore, the annular element on the anvil body requires an increased overall height, as a result of which the accessibility of the joints in shaft-like components is greatly restricted.

WO 01/36124 A2 discloses a tool set of the generic type for producing joints on plate-shaped parts, this tool set comprising a round die. Individual die segments which surround the anvil and are in the shape of ring sections are arranged so as to be displaceable outwards on a supporting surface against spring preloading. In this case, the radial displaceability of the die segments outwards is limited by a stop which encases the supporting surface and is formed by a die sleeve. Furthermore, the stop serves to limit an axial movement of the die segments during their displacement outwards, for which purpose this stop has projecting guides which engage in undercuts of the die segments. A disadvantage in this case is again that the die segments can become skewed relative to the projecting guides and can become jammed as a result.

Furthermore, DE 694 08 080 T2 discloses a tool set of the generic type for producing joints on plate-shaped parts, this tool set comprising a round die. The die has four die segments which are surrounded by a housing. The housing is provided with elongated holes, pins extending into the interior of the housing in each case between two elongated holes. These pins engage in grooves which are formed on the die segments. During an outwards movement of the die segments against spring preloading, edges of the die segments can be moved into the elongated holes of the die housing, the pins which engage in the die segments counteracting a rotary movement of the die segments.

A disadvantage here is that the die segments can become skewed relative to the longitudinal holes, since the displacement is effected against a stop, the die segments being guided solely by supported pins.

An object of the invention is therefore to provide a die for a tool set for mechanical joining which die has a long service life and is at the same time of compact construction.

BRIEF SUMMARY OF THE INVENTION

A die for a tool set for mechanical joining is provided which provides a respective guideway in the die sleeve to each of the die segments. During their displacement directed radially relative to an anvil, the die segments are supported on a supporting surface of a die base body, and are additionally guided directly by the die segment sections which engage in the die sleeve in a slidable manner. Such a die is of compact construction with regard to die height and die diameter and has improved guidance properties for the displaceable die segments.

To achieve this end, the die sleeve has apertures which preferably pass completely through the die sleeve wall and in which the die segments engage by means of a respective extension. The radial displacement path of the die segments lies within the segment guides and therefore leads to no increased extension of the tool in the radial direction. In addition, it is advantageous that dirt can be discharged from the die, as a result of which the service life of the latter can be further improved.

The segment guides in the die sleeve form closed guides which allow sliding of the die segments radially relative to the anvil and at the same time limit axial displacement of the said die segments. The undercuts required in the prior art on the die segments for securing the same against axial displacement from the supporting surface can be dispensed with. The die segments and thus the entire die can consequently have a smaller overall axial height. In this case, the reduced ratio, compared with the prior art, of axial extent to radial extent of the die segments leads at the same time to greater stability against tilting during the radial displacement.

The die is preferably designed to be round and has a die sleeve with guideways extending in the circumferential direction and arranged at a level opposite the supporting surface. The die segments are then preferably designed as ring sections, at least three die segments preferably being provided. Four to six die segments are in particular preferably provided in order to achieve the smallest possible spatial extension of parting seams between the die segments in the expanded state.

The spring preloading is preferably exerted by an elastic ring, which in particular may be a metal spring. For reliable mounting of the elastic ring, the die segments can each have a groove running in the circumferential direction.

The invention is explained in more detail below with reference to the exemplary embodiments shown in the attached figures.

DETAILED DESCRIPTION OF THE INVENTION

Figure 1:
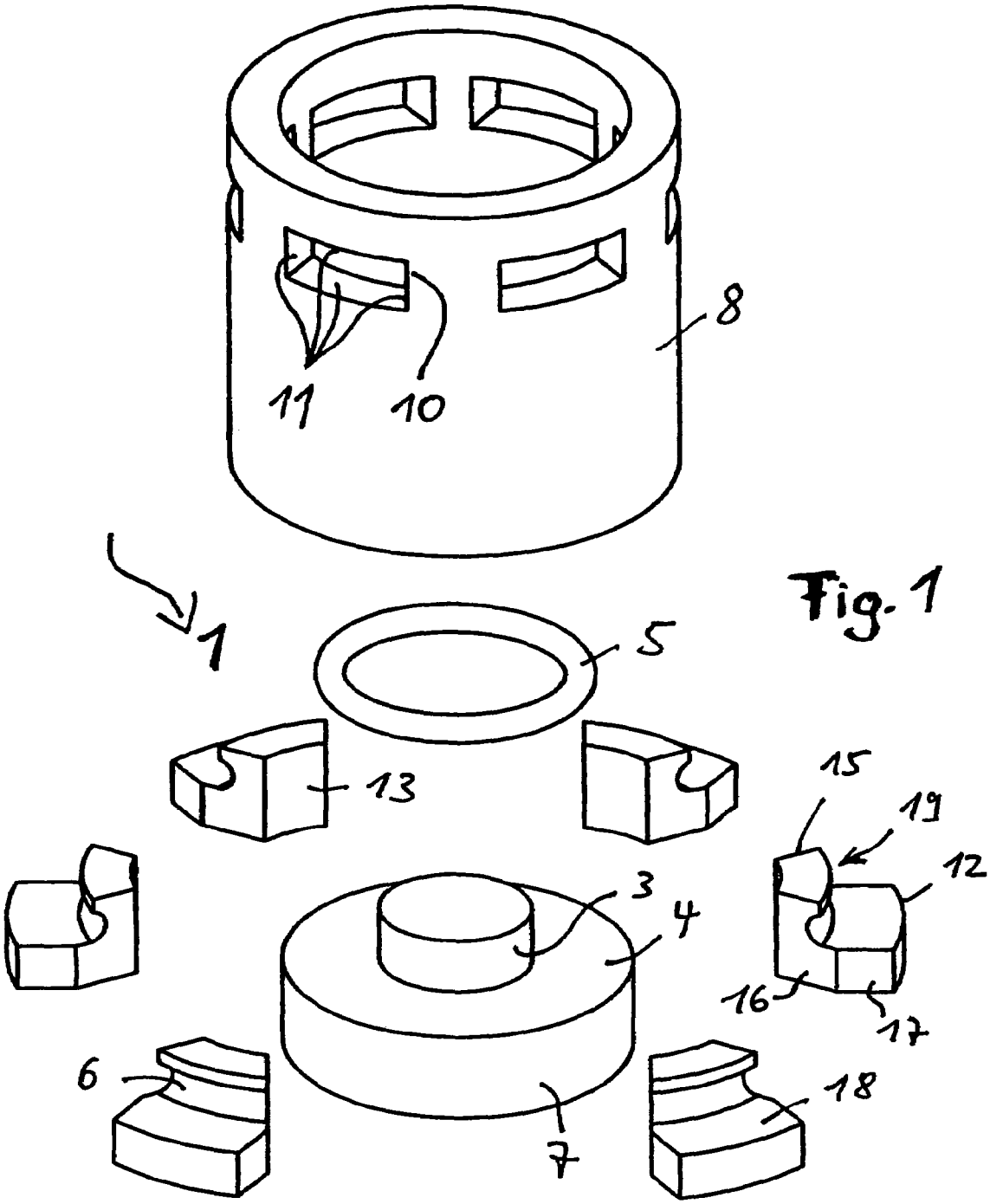
FIG. 1 schematically shows an exploded illustration of a first exemplary embodiment of a die for mechanical joining.
Figure 2:
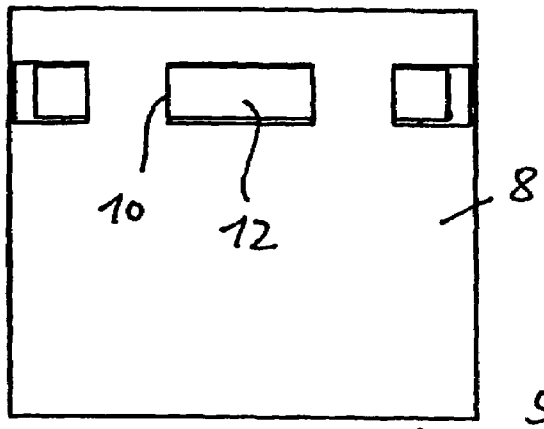
FIG. 2 schematically shows a side view of the die according to FIG. 1 with unexpanded die segments.
Figure 3:
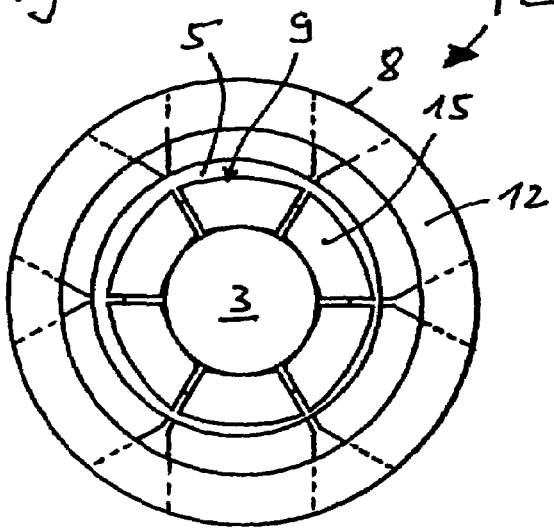
FIG. 3 schematically shows a plan view of the die according to FIG. 2.
Figure 4:
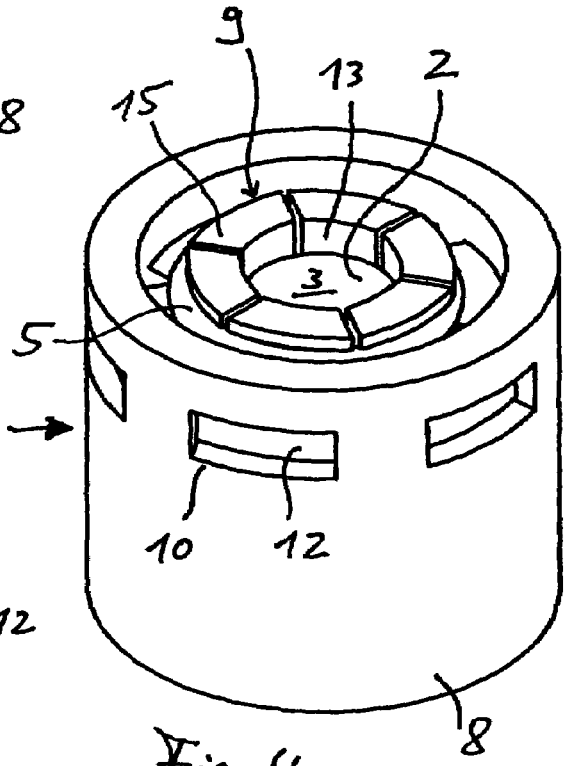
FIG. 4 schematically shows a perspective view of the die according to FIGS. 2 and 3 laterally from the front.

FIGS. 1 to 5 show a first exemplary embodiment of a die 1 for a tool set for the mechanical joining of sheets resting one on top of the other in a planar manner by forming with at least one punch (not shown) and a die 1. The die 1 defines a cavity 2 (cf. FIG. 4) into which joining is effected. To this end, the die 1 comprises an anvil 3 with a head-side anvil face, against which the punch can be moved. Provided on the anvil 3 are individual die segments 9 which define the cavity 2 in the circumferential direction and which, when the punch is being fed in the direction of the anvil 3, execute a yielding movement transversely to an axial extent of the anvil 3 and thus transversely to the punch feed direction. To this end, the die 1 preferably comprises an anvil 3 which is designed as a straight circular cylinder and is formed on a die base body 7.

Provided on the die base body 7 concentrically to the anvil 3 is a flat supporting surface 4, relative to which the anvil 3 projects with a selectable height and which forms a sliding surface for the die segments 9. The supporting surface 4 is preferably arranged perpendicularly to the outer lateral surface of the anvil 3. The supporting surface 4 is preferably provided on the die base body 7 with an anvil 3 arranged in the centre.

Arranged on the supporting surface 4 are a plurality of die segments 9 which, when the punch is being fed in the direction of the anvil 3, execute a yielding movement transversely to the punch feed direction, for which purpose the die segments 9 can be displaced outwards against spring preloading. After an expansion of the die segments 9, the die 1 then closes again automatically.

The spring preloading is effected by means of a spring element 5 which encloses the die segments 9, for which purpose the latter each have an annular groove 6 which runs in the circumferential direction and accommodates the spring element 5 exerting a spring force. The spring element 5 is preferably an annular spring. The die segments 9 can be displaced outwards against the spring force, acting in the direction of the anvil 3, of the spring element 5.

The die 1 also comprises a die sleeve 8 which circumferentially encases the base body 7. The die sleeve 8, in the circumferential direction, following a division into die segments 9, has individual segment guides 10 which form guideways 11 extending through the die sleeve 8, and in which the die segments 9 are guided in a fixed manner in such a way as to be displaceable outwards as sliding pieces formed with an extension 12.

The die segments 9, which are designed in accordance with a division as ring sections, each have an inner curved partial ring surface 13, which faces the anvil 3 and is in contact in the unexpanded state with the outer lateral surface of the anvil 3. The partial ring surfaces 13 define the cavity 2 at the anvil 3 and are formed on a head piece 15, facing the anvil 3, of the die segment 9, on which head piece 15 the groove 6 for the spring element 5 is also provided. The respective extension 12 of a die segment 9 extends from the head piece 15. Whereas the head piece 15 is formed with opposite lateral marginal faces 16 like a piece of flan, that is to say with marginal faces 16 running radially relative to the anvil 3, the extension 12 has opposite lateral marginal faces 17 which run parallel to the anvil radius and which, relative to the circumferential line of the supporting surface 4, lie on secant sections.

Each die segment 9 consisting of head piece 15 and extension 12 preferably has a flat base surface 14 (cf. FIG. 5), with which the die segment 9 rests in a slidable manner on the supporting surface 4 and, with an extension 12 facing away from the anvil 3, projects into a respective segment guide 10. For guidance engagement of a die segment 9 in the die sleeve 8, the extension 12 of the die segment 9 engages as sliding piece in a segment guide 10 designed as a closed guide. The segment guides 10 pass completely through the die sleeve 8. The guideways 11 of the segment guides 10 and the boundary surfaces of the extensions 12 are adapted to one another like sliding guides. To this end, the extensions 12, in addition to the base surface 14, comprise a top guide surface 18 opposite the base surface 14. That surface of the guideway 11 which faces the base surface 14 of a die segment 9 preferably remains disengaged from the die segment 9. The sliding movement of the die segment 9, with its base surface 14, from the supporting surface 4 into the die sleeve 8, is then reliably effected on the supporting surface 4.

Figure 5:
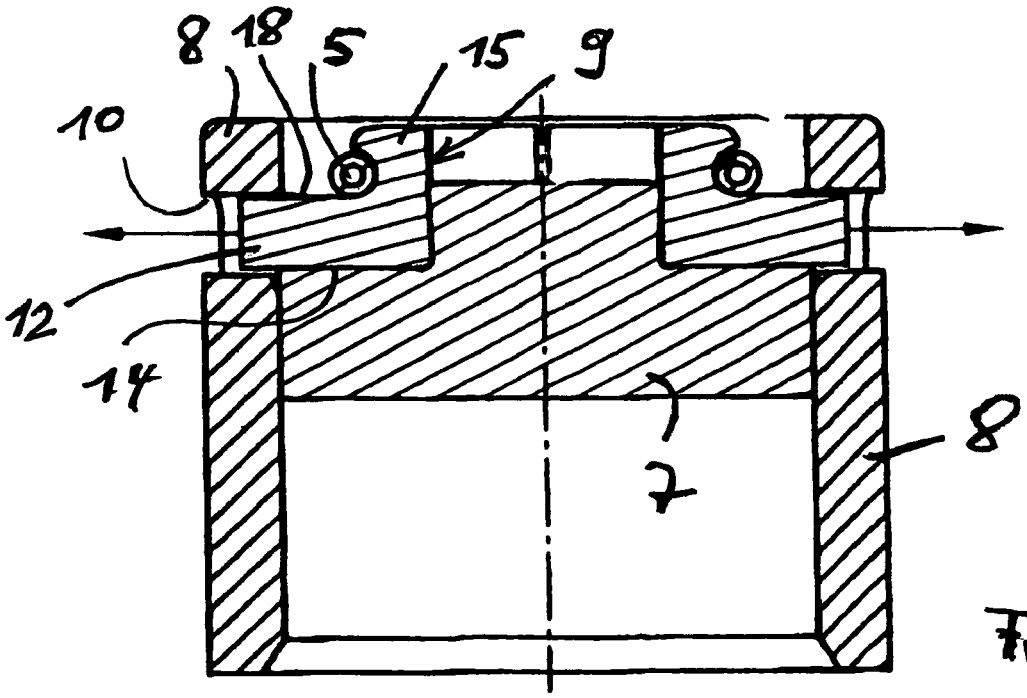
FIG. 5 schematically shows a cross section of the die according to FIG. 1.

In the closed state, shown in FIG. 5, of the die 1, the extensions 12 of the die segments 9 already project with an end piece into the associated segment guide 10, as a result of which each die segment 9 is guided in a fixed manner in this basic position. An axial displacement of the die segments 9 when the same are sliding outwards is thus tightly limited from the start. Furthermore, the radial length of the extension 12 relative to the head piece 15 is selected in such a way that the movable die segments 9 are not limited in travel by the die sleeve 8 during the expansion. The die segments 9 are radially displaced merely against the spring preloading of the spring element 5, which itself is arranged at a distance from the die sleeve 8 and therefore is also not subjected to any limit in travel by the die sleeve 8.

Figure 6:
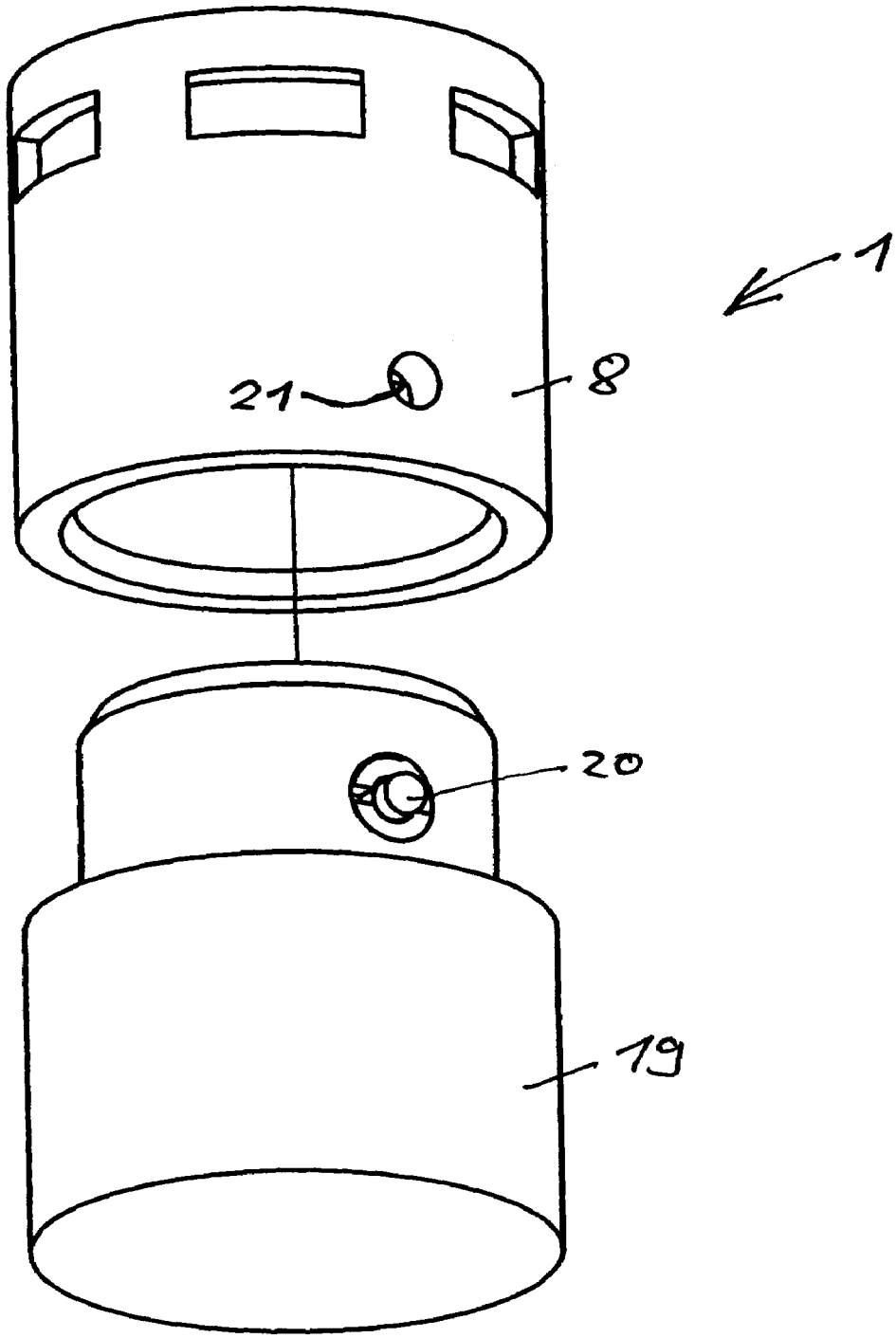
FIG. 6 schematically shows an exploded illustration of a second exemplary embodiment of a die for mechanical joining.

In a second exemplary embodiment, shown in FIG. 6, of the die 1, a quick-release lock for fastening the die described above to a die holder 19 is shown. Provided for this purpose is a spring-loaded pin 20 which is arranged on the die holder 19 radially to the die sleeve 8 and can engage in a radial hole 21 of the die sleeve 8. Screws which are to be released are then not required. Otherwise, the statements with regard to the first exemplary embodiment correspondingly apply here.

According to a modification (not shown) of such fastening, provision may be made for a dog-point headless set screw to be provided instead of the spring-loaded pin, and this headless set screw can preferably be displaced radially by means of a hexagon key, as a result of which the dog point is coupled with or uncoupled from the radial hole of the die sleeve.

Figure 7:
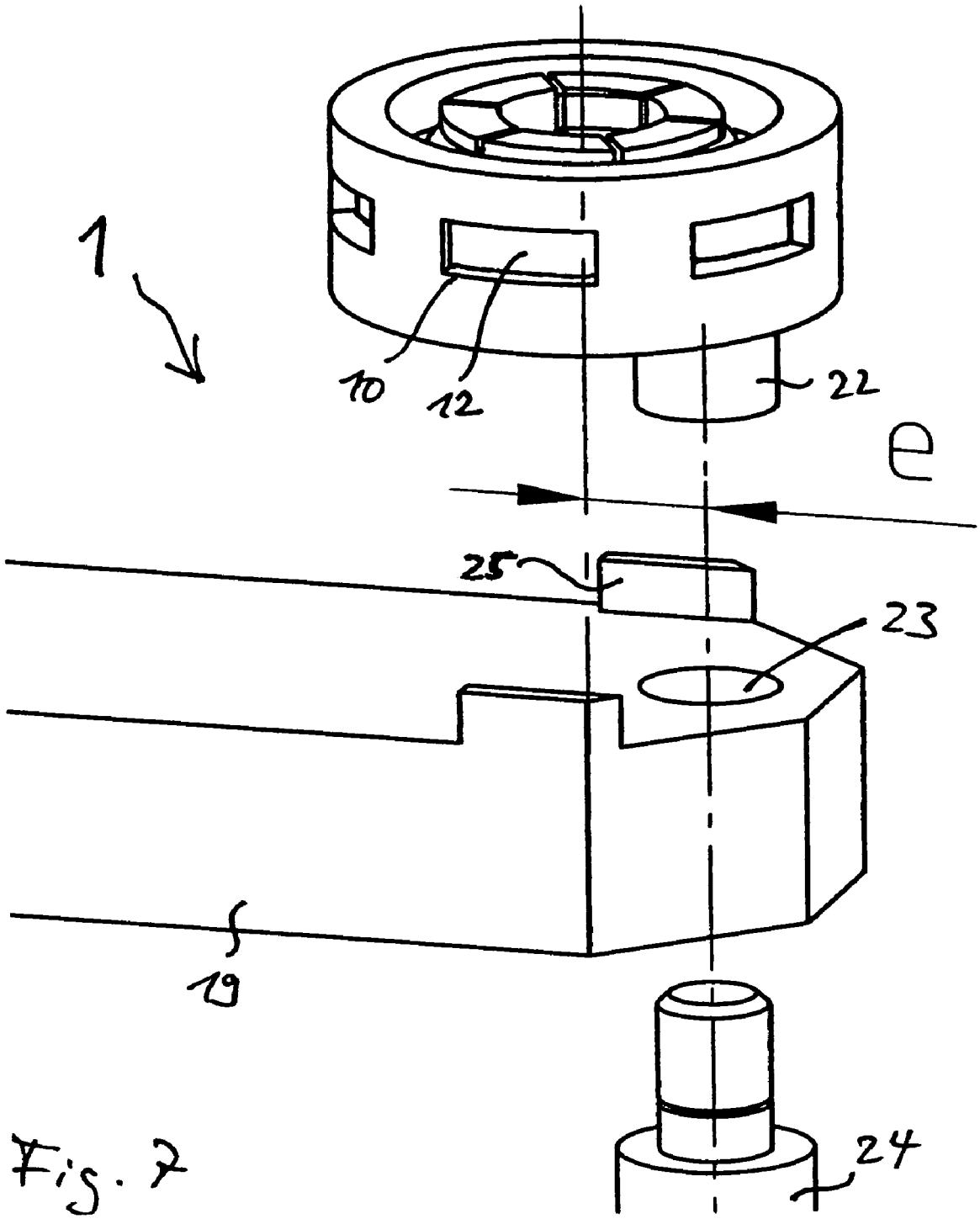
FIG. 7 schematically shows an exploded illustration of a third exemplary embodiment of a die for mechanical joining.

FIG. 7 shows an above-described die 1 with alternative fastening. Here, an eccentric pin 22 with an internal thread is provided on the die base body, which eccentric pin 22 has an eccentricity between die centre and pin centre, can be inserted into a hole 23 of a die holder 19 and can be locked there with a fastening screw 24. Relative to rotation about the eccentric axis, the die 1 is locked by means of anti-rotation locking webs 25. Otherwise, the statements with regard to the first exemplary embodiment correspondingly apply here.

The round anvil 3 described in the exemplary embodiments may have alternative shapes in a modification of the exemplary embodiments.

Although the invention has been described in some detail by way of illustration and example, for purposes of clarity and understanding, it will be obvious that certain changes and modifications may be practiced within the scope of the invention

What is claimed is:

1. A die having a cavity for use in a tool set including at least one punch, said die comprising:

an anvil having a surface which defines a bottom of the cavity;

a plurality of die segments; and a die sleeve disposed circumferentially about the anvil surface and having a plurality of guideways which have parallel side faces and which receive the die segments, wherein the die segments are inwardly spring biased and displaceable outwardly in response to movement of the punch, wherein the die segments are arranged on a supporting surface formed by a die base body having the anvil disposed in its center, and wherein each die segment engages the parallel side face of a guideway during radially outward sliding of the die segment to limit axial displacement of said die segment.

2. A die according to claim 1, wherein the said die is round and the guideways are formed by cutouts in the die sleeve.

3. A die according to claim 1, comprising at least three die segments designed as ring sections.

4. A die according to claim 1, wherein the die segments have side faces which extend along secant lines of a supporting surface.

5. A die according to claim 1, wherein all the die segments have shape which is the same.

6. A die according to claim 1, wherein the die segments have a circular head piece.

7. A die according to claim 6, further comprising annular spring element which circumferentially surrounds the die segments and provides spring biasing.

8. A die according to claim 7, wherein the die segments each have a rear groove which disposes in a circumferential direction and which receives the annular spring element.

9. A die according to claim 8, wherein the annular spring element comprises an annular spring.

10. A die according to claim 2, wherein the die sleeve has a thickness which forms a guide length for the die segment guideways.

11. A die according to claim 1, wherein the anvil is cylindrical.

12. A die according to claim 1, wherein the die sleeve has a hole for engagement of a spring-loaded pin for fastening the die to a die holder on a die holder.

13. A die according to claim 1, wherein the die sleeve has a radial hole for engagement of a dog-point headless set screw on the die holder for fastening the die to a die holder.

14. A die according to claim 1, wherein an electric pin projects from a die base body on a bottom of the anvil and can he inserted into a hole of a die holder and can he locked therein.

15. A die having a cavity for use in a tool set including at least one punch, said die comprising:

an anvil having a supporting surface which defines a bottom of the cavity;

a plurality of die segments on said supporting surface; and a die sleeve disposed circumferentially about the anvil surface and having a plurality of guideways which have parallel side faces and which receive the die segments, wherein the die segments are inwardly spring biased and displaceable outwardly in response to movement of the punch, wherein the die sleeve has a hole for engagement of a spring-loaded pin for fastening the die to a die holder on a die holder, and wherein each die segment engages the parallel side face of a guideway during outward sliding of the die segment to limit axial displacement of said die segment.

16. A die according to claim 15, wherein the said die is round and the guideways are formed by cutouts in the die sleeve.

17. A die according to claim 15, comprising at least three die segments designed as ring sections.

18. A die according to claim 15, wherein the side faces extend along secant lines of a supporting surface.

19. A die according to claim 15, wherein die segments are arranged on a supporting surface formed by a die base body having the anvil disposed in its center.

20. A die according to claim 19, wherein the die segments each have a radial dimension which is longer than a radial dimension of the supporting surface.

21. A die according to claim 15, wherein all the die segments have a shape which is the same.

22. A die according to claim 15, wherein the die segments have a circular head piece.

23. A die according to claim 22, further comprising annular spring element which circumferentially surrounds the die segments and provides spring biasing.

24. A die according to claim 23, wherein the die segments each have a rear groove which disposes in a circumferential direction and which receives the annular spring element.

25. A die according to claim 24, wherein the annular spring element comprises an annular spring.

26. A die according to claim 16, wherein the die sleeve has a thickness which forms a guide length for the die segment guideways.

27. A die according to claim 15, wherein the anvil is cylindrical.

* * * * *